US005275415A

United States Patent [19]

Wisted

[11] Patent Number: 5,275,415

[45] Date of Patent: Jan. 4, 1994

[54] CARD GAME

[76] Inventor: Roger L. Wisted, 10537 Downey Ave., Downey, Calif. 90241

[21] Appl. No.: 893,816

[22] Filed: Jun. 4, 1992

Related U.S. Application Data

[63] Continuation of Ser. No. 682,201, Apr. 5, 1991, abandoned.

[51] Int. Cl.[5] ..... A63F 1/00

[52] U.S. Cl. ..... 273/274; 273/292

[58] Field of Search ..... 273/292, 309, 274

[56] References Cited

PUBLICATIONS

"Scarne's Encyclopedia of Games," Chemin de Fer, (New York: Harper and Row), 1973, pp. 9, 290-303.

*Primary Examiner*—Vincent Millin

*Assistant Examiner*—William M. Pierce

*Attorney, Agent, or Firm*—Harlan P. Huebner

[57] ABSTRACT

A card game and method of playing the same played with a fifty six card deck and played to a predetermined unique point total on a table having a playing surface and several player stations surrounding said table and a card dealer station located between two of the players, and said dealer does not play hands, in which each station where a player is located initially receives two cards face down with the player adding the value of said cards and each player in rotation to receive one or more cards face up or to stand on the original cards in an endeavor to reach the point total, each player playing against the other of said players and a winning player having the point total or a total less than or greater than said point total.

6 Claims, 3 Drawing Sheets

CARD GAME

This is a continuation of application Ser. No. 07/682,201, filed Apr. 5, 1991, now abandoned.

BACKGROUND OF THE INVENTION

1. Field of the Invention

This invention relates to a card game and method of playing the same such as would be played at a casino and to a table, special deck of cards, player positions and wager card and bet placement areas.

2. Description of the Prior Art

Various prior art card games used in gaming casinos are relatively complicated and require knowledge beyond an unskilled person player.

Blackjack or Twenty-one is an exception to the above paragraph as it does possess a simplicity of counting. It is also a widely played casino game. However, in certain states where there is local option for card casinos, Blackjack is outlawed per se by the state.

Applicant is aware of a casino card game protected by U.S. Pat. No. 4,659,087, however this game requires players to maintain two pairs of cards while playing as well as requires the dealer to play and usually is the bank. Such play is entirely different than the present invention.

Therefore, it is desirable to create other card games for playing in casinos that are both simplistic as well as a "legal" card games within the political body having jurisdiction over card casinos.

SUMMARY OF THE INVENTION

It is the purpose of the present invention to provide a relatively simple card game to play that is not Blackjack but requires counting of card values to reach a predetermined unique point total or near thereto.

Another object of the present invention is to provide a card game with the object to make a point total count of twenty two points or as close to it as possible.

A further object of the present invention is to provide a card game wherein the deck of cards used totals fifty six cards which is a conventional deck of fifty two cards with four jokers. A conventional deck of fifty two cards may also be used without the need for any additional cards.

A still further object of the present invention is to provide a card game wherein the card values on two's or deuces through nines are their face value for points, tens and the count cards count as 10 points each, and aces and jokers count as 1 or 11 points each.

Another object of the present invention is to provide a table and table covering which includes player stations for up to eight players plus a dealers station or "house station." The players may be seated around the table while it is preferable that the dealer stands.

A yet further object of the present invention is to provide a card game where the dealer in the dealers station or "house station" does not deal cards to the station but only to the players. However, initially one of the players is designated the "dealer" by some means such as the throw of dice and all play for that round starts to the left of the "dealer" and progresses clock wise ending with the dealer. The dealer then with each new hand moves clockwise to the next person.

Another object of the present invention is to provide a card game wherein the table includes individual player stations wherein a plurality of wagers may be positioned as well as for placement of "up" and "down" cards.

A further object of the present invention is to provide a card game wherein each player makes a wager or wagers and is then dealt two face "down" cards. Each player may look at the face "down" cards and consider whether the total count makes 22 or less. If 22 that person could automatically be a winner stands pat or may receive "hits" in the form of additional "up" cards until 22 is reached or exceeded or the total is less than 22 but considered by the player sufficient to "stand on."

These and other objects and advantages will become apparent from the following part of the specification wherein details have been described for the competence of disclosure, without intending to limit the scope of the invention which is set forth in the appended claims.

BRIEF DESCRIPTION OF THE DRAWINGS

These advantages may be more clearly understood from the following detailed description and by reference to the drawings in which.

DETAILED DESCRIPTION OF THE PREFERRED EMBODIMENT

Figure 1:
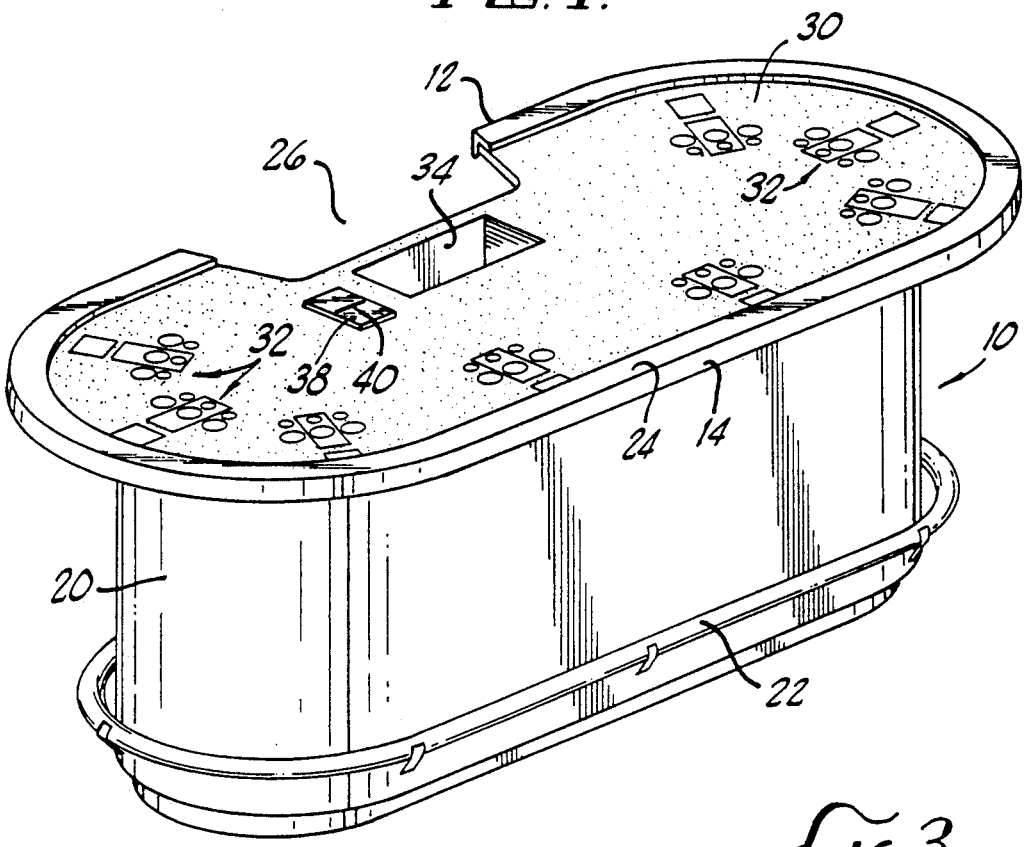
FIG. 1 is perspective view of the table to be used for the card game with a playing surface.

The table generally designated 10 can be very similar to or may be a conventional poker table as used in gaming casinos. The table is generally elliptical with opposed straight sides 12 and 14 and rounded ends 16 and 18 uniting the sides 12 and 14. The vertical support 20 may be one piece as shown or a veneer wrapped around legs (not shown). In addition a foot rail 22 may be attached to the support 20 for the feet of the players.

The table 10 preferably includes an upholstered raised pad 24 that is positioned around the edge of the table 10 except for opening 26 in the straight side 12. The opening 26 is known as the house dealers opening where the dealer 28 stands to deal cards, declare winners collect house amounts of money and to collect wagers from and pay players at the conclusion of a game.

The top of the table 10 is fitted with a playing surface or "felt" 30 which is usually a green felt pad with various indicia printed thereon for various player positions or player stations designated 32.

The table 10 is preferably equipped with an opening or dealers opening 34 in front of the dealers opening 26 to receive a dealer's tray (not shown) which may include chips and cards which can be used by the players.

In addition, next to opening 34 is a cash lock box 36, not seen, set into the table that has a cover 38 with a slot to insert paper currency and a plunger 40 to push the paper currency into the lock box.

The particular table 10 illustrated in the drawings is designed to allow eight players 42 represented by circles with the numbers "1" to "8" therein to play there around. Thus, on the felt 30 there are illustrated eight player stations designated 32.

Figure 3:
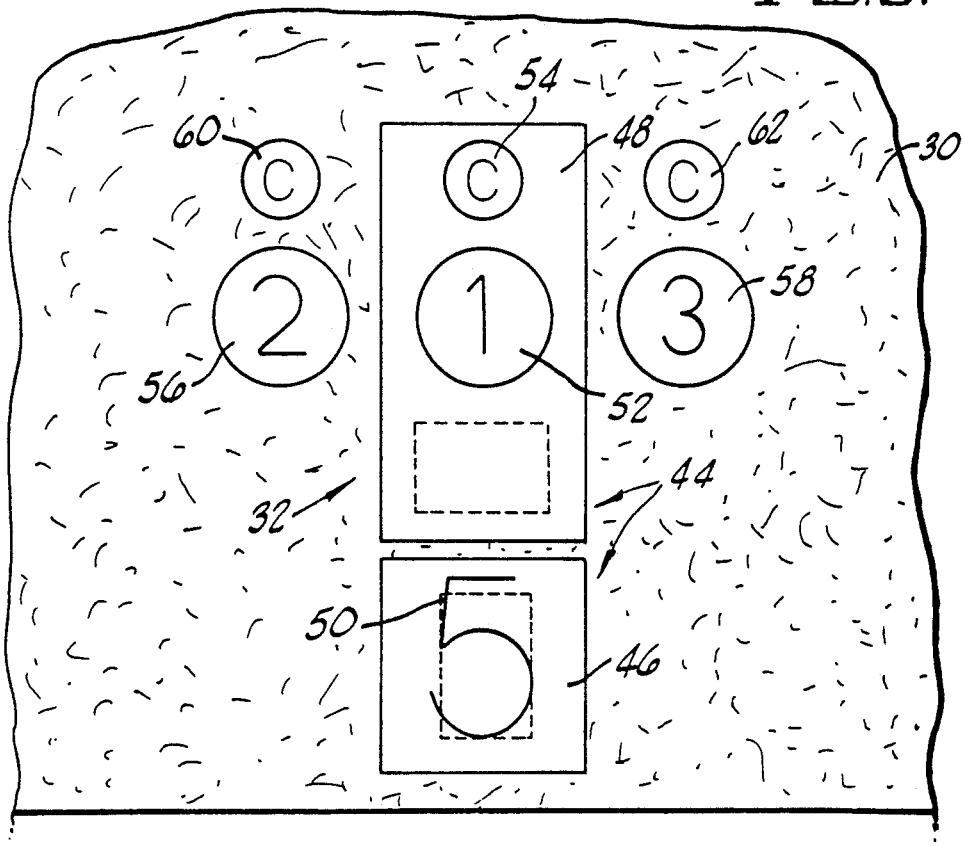
FIG. 3 is an enlarged detail view of a player's station.
Figure 2:
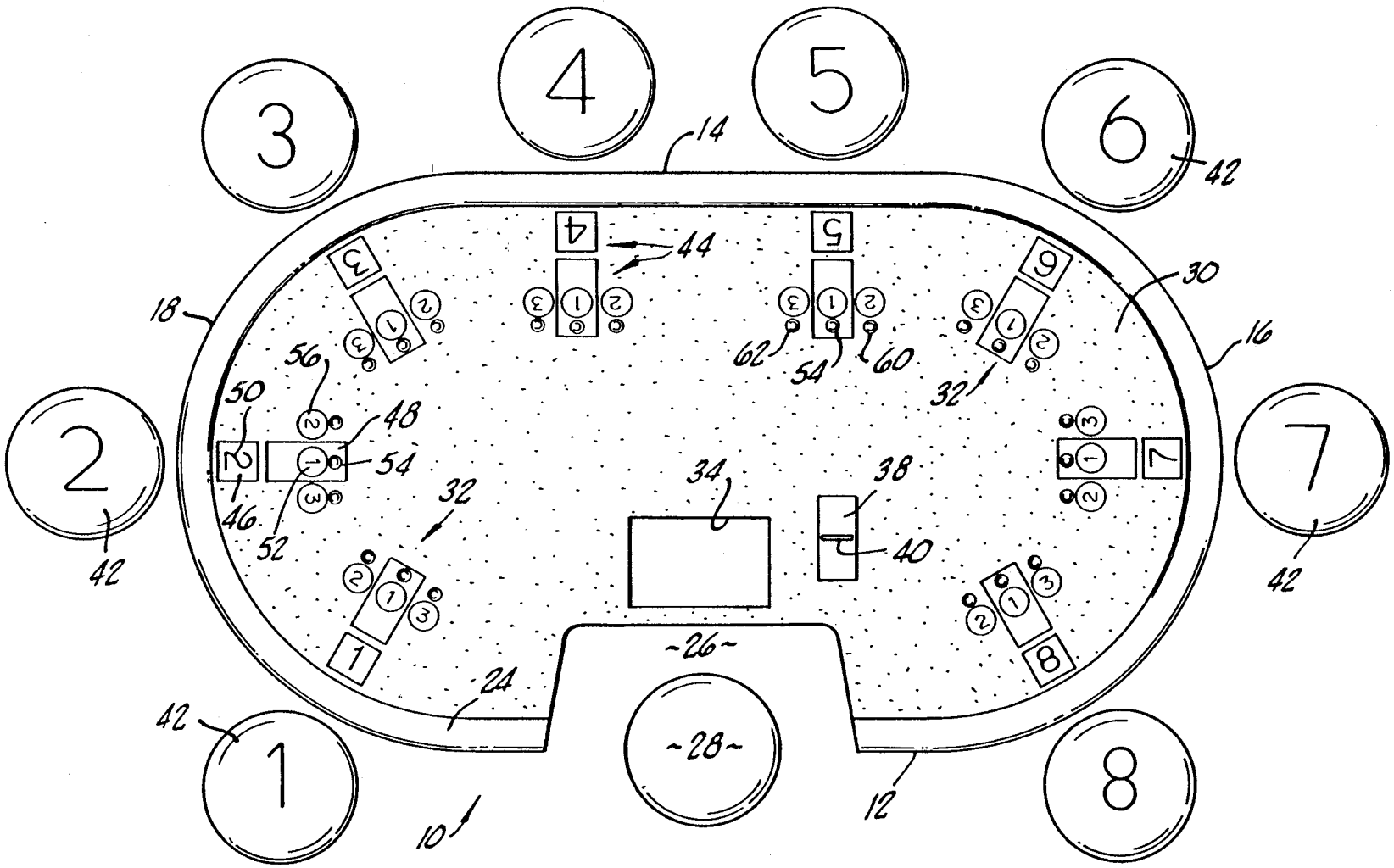
FIG. 2 is a top plan view of the table showing the arrangements on the table together with the positions of the players and house dealer.
Figure 4:
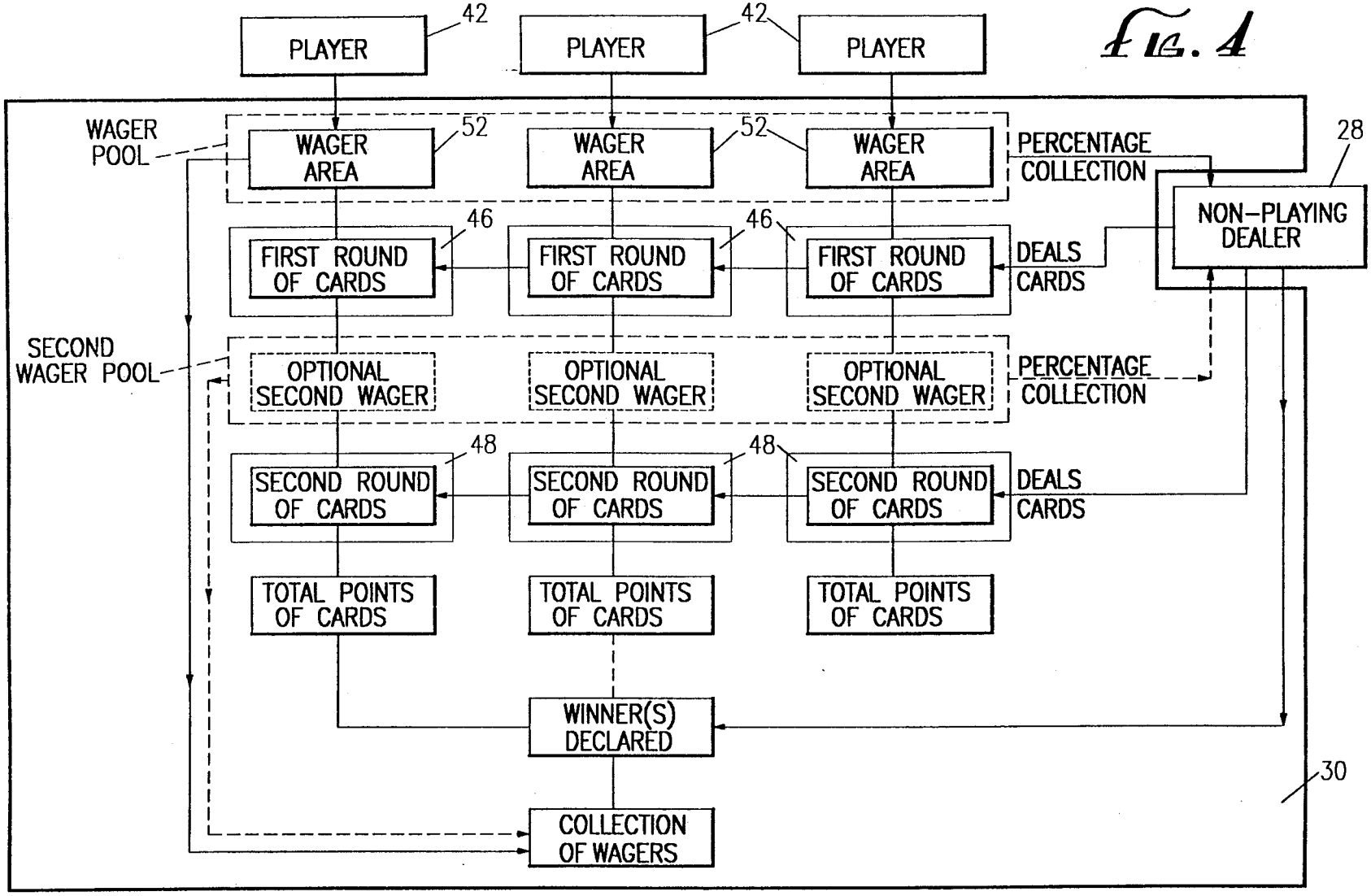
FIG. 4 is a flow chart illustrating the method of playing the game.

Turning now to the individual player stations 32, FIG. 3 illustrates various parts of the station.

Each of the stations 32 include a card receiving area designated 44 which preferably includes a face down card rectangle 46 and an elongated wagering and betting face up card rectangle 48 which is aligned with rectangle 46. While two rectangles 46 and 48 are preferred and illustrated a single elongated quadrilateral may be used without departing from the spirit of the invention. In addition, any other closed sided shape would also work.

The face down card rectangle 46 as with all of the station parts are preferably of a contrasting color from the color of felt 30.

Within the rectangle 46 a number 50 is printed. This is the seat, player or station number which may assist the dealer 28 with play of the game. Also the rectangle 46 is the area where the face down cards (see dotted lines) from a special deck of cards, to be explained, are dealt.

Within the wagering and up card rectangle 48 there is positioned a principle bet receiving area or circle 52 and a house collection circle 54 to be explained. The dealer 28 will deal face up cards (see dotted lines) within the perimeter of the rectangle 48.

The reason for having specific outlined areas to receive cards is to control the game and lessen chances of cheating by a player.

The number "1" in the circle 52 designates to the player 42 that this is the area into which the wager is placed. In the case of gaming casinos chips are bought and used and stacked within the circle 52 when wagering.

The "C" in circle 54 identifies the collection area for chips to be paid to the "house" or gaming casino by each player for the privilege of playing, to defray expenses and for profits to the casino. The reason for the collection area is that in the present game the house does not play, only player plays player.

On both sides of the card area 44 are supplemental wagering circles 56 and 58 for making side bets and supplemental collection circles 60 and 62. The supplemental wagering circles 56 and 58 contain the numerals "2" and "3" which are to be used for additional or side wagers against other players all to be explained. The collection circles 60 and 62 will receive the supplemental chips a player 42 pays to the house for the privilege of making supplemental wagers in either circle "2" or circle "3".

In order to describe the operation of the invention, the rules of the game shall be set out below:

PLAY

The game is played with a deck of fifty six cards, four jokers being added to a conventional deck of fifty two cards. For the sake of fairness in the drawing of cards and to keep control of the game a maximum of eight players 28 may be allowed. A conventional deck of fifty two cards may also be used without the need for any additional cards.

The house or casino furnishes the table 10 and a dealer 28 who does not play. The dealer's functions are to determine that the wager is proper, deal the cards, collect the house portion of wagers, declare winners and settle the wagers of the players. In addition, the dealer is to keep track of the side wagers using the supplemental circles 56 and 58.

The object of the game is to make a point total as close to twenty two as possible. Cards numbered two through nine count as their face values, tens and all court cards count as ten points each, aces and jokers count as one or eleven each.

Once a "dealer" is selected from among the players 42 at a table 10 by a roll of dice or other means, a token may be placed in front of that player and all play rotates clockwise from the first player 42 to the left of the "dealer".

However, before play begins and cards are dealt it is necessary to place a wager in circle 52. This is the primary place for wagers up to a house set maximum. All players must make a wager not to exceed the maximum and place it in circle 52. The supplemental circles 56 and 58 are optional for a player 42. These preferably are arranged to allow higher maximum wagers, with circle 56 having one maximum and circle 58 having a still higher wager maximum.

Once the wagers are made around the table 10, the dealer 28 will see that the house percentage is placed in collection circles 54 and 60 and 62 if supplemental wagers are made.

With the wagers made and the "dealer" chosen, play commences. The dealer will deal a first round of two cards down to each player placing then in the rectangle 46. The player may look at the cards. At this point the players 42 may make additional wagers before drawing additional cards or may stand pat on the two down cards. Each player plays the other players and not the house.

Each player is then given an opportunity to draw additional cards in a second round which are dealt face up in the rectangle 48. The object is to draw cards to make a total as close to twenty two as possible. However, the game differs from traditional Blackjack in that hands totaling more than twenty two points are not automatically "busted," but the player 42 may not draw further cards once they total more than the twenty two points. Of course it is possible for one exceeding twenty two to win. As an illustration if one player has cards totalling twenty four and another has cards totaling nineteen points the former would win.

Also, it is possible to have multiple winners in a game where they are tied in points or they each have the same difference above and below twenty two, i.e. twenty total points and twenty four points.

The present card game also differs from Blackjack in that if the original two cards dealt to a player total twenty two the player does not automatically turn the cards over. The reason is that in the preferred embodiment the players are in effect playing each other such as in poker. Therefore, the person with twenty two merely places a second wager on the table if he wishes and passes when the house dealers ask him if he wants any additional cards.

Further, in the present card game a player may not "split" opening cards if there are, as an example two kings. In addition, there is no "doubling" as is allowed in Blackjack.

Once the first two cards are dealt the house dealer will then deal face up additional cards to players who verbally or physically request cards. Again the player selecting additional cards is endeavoring to have a total card count of twenty two.

At the conclusion of a game, the house dealer will then declare a winner or winners, pay the winners from the losers wagering circles in rotation starting from the left of the player "dealer."

As an alternative method of play, it is possible to offer the player "dealer" a chance to bank the game, but again the house dealer does not play a hand.

Finally, while the preferred game calls for a desired point total to be twenty two, it is possible to increase the total above that number without departing from the spirit of the invention.

The invention and its attendant advantages will be understood from the foregoing description and it will be apparent that various changes may be made in the form, construction and arrangements of the parts without departing from the spirit and scope thereof or sacrificing its material advantages, the arrangements herein before described being merely by way of example. I do not wish to be restricted to the specific forms shown or uses mentioned, except as defined in the accompanying claims, wherein various portions have been separated for clarity of reading and not for emphasis.

I claim:

1. A method of playing a card game among a plurality of players playing against each other with the ultimate game objective of receiving cards with a total sum point count reaching a predetermined optimum point total or as close as possible above or below said optimum point total including the steps of:

providing a deck of at least fifty two cards each having a face side and numbers from two to ten respectively thereon, or picture cards each having an assigned value of ten or aces and if joker cards each having an assigned value of either ten or one at the option of a player;

placing a required wager by each of said players before said card game commences;

providing a dealer to collect a percentage of said wagers and to deal said cards;

dealing by said dealer of a first round of two cards face down to each of said players in rotation, and none to said dealer, and each player looking at said faces of their said cards and adding the numerical or assigned value of said cards to compare the total value of said cards to compare the total value of said cards to said optimum point total;

determining by each player whether a third card or more cards may be desired;

dealing by said dealer a second round of cards to any player in rotation that wants a card or cards and each card is dealt face side up; and said player adds the value of each of said face side up cards to said first numerical value of said first round of cards to achieve a numerical point total;

turning over said down cards, and announcing said point total by said dealer for each player;

declaring by said dealer one or more winners whose numerical point total of said cards equals said predetermined point total or if said optimum point total has not been achieved declaring that player or players with a numerical point total closest to said predetermined optimum point total above or below the same; and collecting by said one or more winners said wagers less said percentage, of players not declared winners.

2. A method of playing a card game as defined in claim 1 further comprising the optional step of;

making additional voluntary wagers by any of said players before said second round of cards in dealt; and collecting by said dealer of a percentage of said additional voluntary wagers.

3. A method of playing a card game as defined in claim 1 further comprising the optional step of:

providing four jokers as additional cards to the deck of at least fifty two cards each with an assigned value of one or ten at the option of each player.

4. A method of playing a card game as defined in claim 1 further comprising the initial step of:

providing a table having a playing surface and a periphery, a number of players stations provided around said table adjacent said periphery, and a card dealer station for said dealer located between two of said player stations; and including at each station on said playing surface a card receiving area demcarcation to receive said face down cards and a card receiving area demarcation to receive said face up cards, at least one wagering area demarcation for said wagers; and at least one collection area for receiving said percentage of said wagers.

5. A method of playing a card game as defined in claim 4 wherein the step of providing a table includes:

providing three wagering area demarcations on said playing surface for wagers, one within said card receiving area demarcation for the initial required wager and one on either side of said card receiving area demarcation area providing an area for placing additional wagers of other than the required wager.

6. A method of applying a card game as defined in claim 4 wherein there is the step of:

providing the playing surface of one color and the surface area demarcations of contrasting colors.

* * * * *

UNITED STATES PATENT AND TRADEMARK OFFICE

CERTIFICATE OF CORRECTION

PATENT NO. : 5,275,415

DATED : January 4, 1994

INVENTOR(S) : Roger L. Wisted

It is certified that error appears in the above-identified patent and that said Letters Patent are hereby corrected as shown below:

Column 5, Line 31, "ten" should be --eleven--;

Column 6, Line 23, "ten" should be --eleven--;

Signed and Sealed this

Twentieth Day of May, 1997

*Attest:*

*Attesting Officer*

Bruce Lehman

BRUCE LEHMAN

*Commissioner of Patents and Trademarks*